US007098429B2

(12) United States Patent
Angermann et al.

(10) Patent No.: US 7,098,429 B2
(45) Date of Patent: Aug. 29, 2006

(54) HEAT EXCHANGER, PARTICULARLY FOR A HEATING OR AIR CONDITIONING UNIT IN A MOTOR VEHICLE

(75) Inventors: Hans-H. Angermann, Stuttgart (DE); Roland Burk, Stuttgart (DE); Herbert Damsohn, Aichwald (DE); Markus Watzlawski, Ostfildern (DE)

(73) Assignee: BEHR GmbH & Co. KG, Stuttgart (DE)

( * ) Notice: Subject to any disclaimer, the term of this patent is extended or adjusted under 35 U.S.C. 154(b) by 0 days.

(21) Appl. No.: 10/513,696

(22) PCT Filed: May 15, 2003

(86) PCT No.: PCT/EP03/05109

§ 371 (c)(1),
(2), (4) Date: Nov. 8, 2004

(87) PCT Pub. No.: WO03/098124

PCT Pub. Date: Nov. 27, 2003

(65) Prior Publication Data

US 2005/0150885 A1 Jul. 14, 2005

(30) Foreign Application Priority Data

May 17, 2002 (DE) ..... 102 21 967

(51) Int. Cl.
*B60L 1/02* (2006.01)

(52) U.S. Cl. ..... 219/530; 219/202; 219/208

(58) Field of Classification Search ..... 219/530, 219/202, 208, 534, 542; 392/408–482, 468, 392/496

See application file for complete search history.

(56) References Cited

U.S. PATENT DOCUMENTS

| | | | |
|---|---|---|---|
| 6,124,570 | A | 9/2000 | Ebner et al. |
| 6,178,292 | B1 | 1/2001 | Fukuoka et al. |
| 6,265,692 | B1 | 7/2001 | Umebayahi et al. |

FOREIGN PATENT DOCUMENTS

| | | | |
|---|---|---|---|
| DE | 44 36 791 | A1 | 4/1996 |
| DE | 198 58 499 | A1 | 6/2000 |
| DE | 100 12 320 | A1 | 9/2000 |

*Primary Examiner*—Robin Evans
*Assistant Examiner*—Vinod Patel
(74) *Attorney, Agent, or Firm*—Foley & Lardner LLP

(57) ABSTRACT

The invention relates to a heat exchanger, particularly for a heating or air conditioning unit of a motor vehicle, comprising several flat pipes which are arranged parallel to each other and are penetrated by a heat-transmitting medium. An electrically operated heating element (114) which is mounted once the heat exchanger has been soldered is assigned to at least one part of the flat pipes as an additional heating device. Said heating element (114) is fixed to the heat exchanger by means of a holding element (115The inventive heat exchanger is characterized by the fact that each heating element (114) is mounted in front of the corresponding flat pipe and parallel thereto by means of the holding element (125) which also runs parallel to the flat pipe.

11 Claims, 14 Drawing Sheets

HEAT EXCHANGER, PARTICULARLY FOR A HEATING OR AIR CONDITIONING UNIT IN A MOTOR VEHICLE

BACKGROUND OF THE INVENTION

The invention relates to a heat exchanger, particularly for a heating or air conditioning unit in a motor vehicle.

In low-consumption vehicles because of the small amount of waste heat available, additional heat capacity is required in order to heat the passenger space and for the rapid elimination of a coating (ice or water) particularly on the windshield. For this purpose, it is known in heat exchangers constructed from flat tubes through which flows a heat transfer medium which emits heat in a heating situation, to provide, at least on the outer tubes, an additional heating in the form of PTC heating elements. However, the mounting of PTC heating elements of this type is highly complicated.

U.S. Pat. No. 6,124,570 proposes to replace individual tubes of the heat exchanger by PTC heating elements held between contact plates which at the same time make a heat-conducting connection to the adjacent ribs. This has the disadvantage that the structural adaption of the heat exchanger in order to receive PTC heating elements and the PTC heating elements themselves are very costly. For this reason, it may be that a combined heat exchanger of this type is more costly than a combination of a conventional heat exchanger with a separate PTC heater. Also, due to the construction space requirement for the PTC heating elements and the contacting of these, the power density of the heat exchanger is markedly impaired. The replacement of individual tubes of the heat exchanger may also be gathered from DE 44 36 791 A1 and DE 100 12 320 A1.

Furthermore, it is proposed in DE 198 58 499 A1, to design the flat tubes as multichamber profiles and to design at least one of the outer chambers in the form of an insertion groove for an insulated resistance wire, the walls of said insertion groove then being bent together in order to fasten the resistance wire. The resistance wire is inserted after the soldering of the heat exchanger. This has the disadvantage that a heat exchanger of this type requires special flat tubes and a large part of the electrically introduced heating capacity is absorbed into the coolant.

U.S. Pat. No. 6,178,292 B1 discloses a heat exchanger with an electrical heater which is arranged within a carrier element and which is pushed between two adjacent rib sets. In this case, the carrier element includes a pair of parallel plates, between which an electrical heating element is held and is contacted electrically. The electrical heater consists of a heating element and of an insulation element and has a multilayer construction through which a heating current passes essentially perpendicularly to the individual layers. Fastening elements, which run perpendicular to the carrier element and heater, are provided for the fastening. A heat exchanger of this type still leaves much to be desired, particularly as regards the multiplicity and number of parts and consequently the production costs of the heating body as a whole.

SUMMARY OF THE INVENTION

The object of the invention is to make available an improved and more cost-effective heat exchanger.

According to the invention, a heat exchanger, particularly for a heating or air conditioning unit in a motor vehicle, with a plurality of flat tubes which are arranged parallel to one another and through which a heat transfer medium flows, is provided, which has, outside and preferably on the air outflow side of the flat tubes, a heating element which runs parallel to the flat tubes. In this case, a holding element, which likewise runs parallel to the flat tubes, is provided for the heating element. The heating element is arranged outside the flat tubes. In particular, by the choice of the heat-conducting cross sections from the heating element to the flat tubes through which the heat transfer medium flows, the heat flow is minimized and the heat flow discharged to the air via rib surfaces is maximized. The holding element is preferably a holding grid, in which case the holding element may also be formed directly by the heat exchanger, particularly the rib sets of the latter, preferably when these project. A plurality of heating elements and/or of holding elements may also be provided. The heating element is preferably a component of grid-like design, preferably made from high-grade steel. For optimum heat transfer, the heating element is connected thermally conductively to the holding element and/or is mounted on the heat exchanger.

According to one embodiment, the holding element is mounted on a flat tube. In this case, a conventional flat tube may be used, to which the holding element is fixed, for example by means of soldering, and the heating element is subsequently introduced. Mounting preferably takes place on a narrow side face of the flat tube, said side face pointing outward, that is to say, away from the heat exchanger.

According to an alternative embodiment the holding element is mounted on one or more ribs. In this case, the ribs are led beyond the flat tubes so that the holding element can be fixed between the ribs.

According to a further alternative embodiment the holding element is formed directly by ribs. In this case, the ribs are led beyond the flat tubes so that the heating element can be fixed directly or else indirectly between the ribs.

In order to avoid damage to the heating element, the ribs may be rounded or provided with a chamfer on one, but preferably on both sides, thus making it easier to introduce the holding and/or heating element.

According to a preferred embodiment, the heating element is designed as a heating grid. In this case, the holding element is preferably formed by a holding grid, in which case the heating grid may also be held directly by the ribs serving as holding element.

To avoid a short circuit, the heating element or heating elements and/or the holding element or holding elements have an insulating coating or are provided with such a coating, for example with Teflon or an insulating lacquer. Preferably, in this case, an aluminum holding grid is provided which is insulated electrically by means of anodizing. However, other electrically nonconductive or poorly conducting coatings or surface treatments are also possible.

By the resistance being increased by means of a meander structuring of the heating grid, the current flow through a section can be markedly reduced. This affords the possibility of using cost-effective polymeric PTC elements of low current carrying capacity for thermal protection.

Preferably, one or more excess temperature cutouts are provided, which, in particular, are interposed directly in the heating section. These may be, for example, series-connected thermal switches. Bimetallic switches, polymeric PTCs, ceramic PTCs or fusible cutouts are essentially considered for this purpose. Preferably, in this case, what are known as polyswitch or polyfuse elements are used which are in thermal contact either with the heating body itself or with the air flowing through the latter. Owing to their intrinsic heating when the discharge of heat is too low, these can practically break the respective heating circuit. These known protective elements are based on conductive polymers which have a pronounced PTC effect. That is to say, when a certain temperature (reference temperature) is exceeded their electrical resistance rises by several orders of magnitude and the current intensity decreases correspondingly, with the result that electrical power is reduced to values near zero. Alternatively to these polymeric PTC elements, however, bimetallic switches may also be used, which either are in thermal contact with the heating body itself or are arranged in the airstream which also flows through the heating body. In the latter instance, the bimetallic switches are designed in terms of their electrical resistance in such a way that, on account of the current flow, they have low intrinsic heating which, however, is not so low that the cutoff temperature is reached when an airstream flows around them. Only when the airstream falls below a critical value due to a system fault does the intrinsic heating of the bimetallic switch result in the cutoff temperature being reached.

In a preferred embodiment, these excess temperature cutouts are in direct heat-conducting contact with the heating body and are part of the heating grid which is located in a holding grid.

BRIEF DESCRIPTION OF THE DRAWINGS

The invention is explained in detail below by means of exemplary embodiments, with reference to the drawing in which.

DETAILED DESCRIPTION OF THE INVENTION

Figure 1:
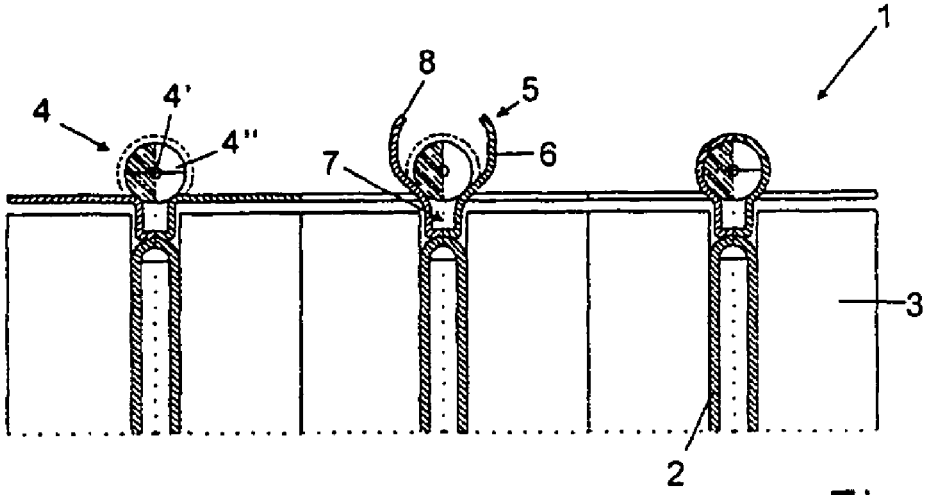
FIG. 1 shows three steps for the production of a heat exchanger in a first exemplary embodiment according to the invention.

A heat exchanger 1 according to the invention for an air conditioning unit of a motor vehicle, particularly for a low-consumption vehicle, with a plurality of flat tubes 2 which are arranged parallel to one another and through which a heat transfer medium flows and with rib sets 3 arranged between the flat tubes 2, has electrically operated heating elements 4 as additional heating which can be connected as required. The flat tubes 2 are connected to a system 133 for circulating a first heat transfer medium through each of the flat tubes 2, schematically depicted in FIG. 17. The heating elements 4, consisting of a resistance wire 4' and of an insulation layer 4", are held by means of the holding elements 5, in the first exemplary embodiment by means of a holding grid 6 which is soldered on a narrow side of each flat tube 2.

The holding grid 6 is produced from a metal sheet which is provided by means of a forming operation with beads 7 serving for subsequent soldering, in which case soldering may take place simultaneously with the soldering of the remaining heat exchanger, since the heating elements 4 cannot, as a rule, be exposed to the soldering operation.

The mounting of the heating elements 4 is illustrated in detail in FIG. 1. The left part of FIG. 1 shows the positioning of the heating element 4 on the holding element 5 soldered to the flat tube 2, the forming of the holding element 5 is illustrated in the middle and the heating element 4 ready-fixed with the aid of the holding element 5 is illustrated on the right. In this case, the ends 8 of the holding grid 6 are crimped shut.

The beads 7 on the one hand, serve for positioning the holding grid 6 and the heating elements 4 and, on the other hand, form a heat-conducting connection to the heat exchanger 1, in order to utilize part of the rib surface of the latter for the transfer of heat to the air flowing through.

Depending on the electrical resistance, on-board voltage and desired electrical heating power, the individual heating elements 4 may be connected by means of a parallel and/or series connection in a way not illustrated in any more detail. For power regulation, a pulse-width modulation method is used, but other methods for power regulation are also possible.

Figure 2:
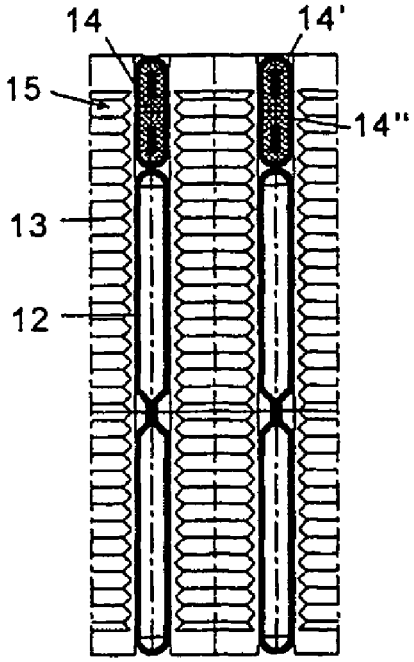
FIG. 2 shows a second exemplary embodiment.

Three very similar exemplary embodiments are described below with reference to FIGS. 2 to 4. In these and all the following exemplary embodiments, elements not described in any more detail are identical to those of the first exemplary embodiment described above. According to the exemplary embodiment illustrated in FIG. 2, heating elements 14, consisting of a resistance wire 14' and of an insulation layer 14", are pressed directly into projecting rib sets 13 which are configured in such a way that they project sufficiently far beyond the flat tubes 12, in the present case, conventional beaded tubes, so that they themselves form the holding elements 15. If required, the heating elements 14 may additionally be surrounded by a metallic casing and be secured between the ribs, for example by means of adhesive bonding. In this case, the heating elements 14 have a sheet-like configuration such that their thicknesses correspond approximately to the thickness of the flat tubes 12. At the same time, in the present instance, the heating elements 14 consist of two individual heating conductors, so that current inward and return routing is provided within a heating element 14.

Figure 3:
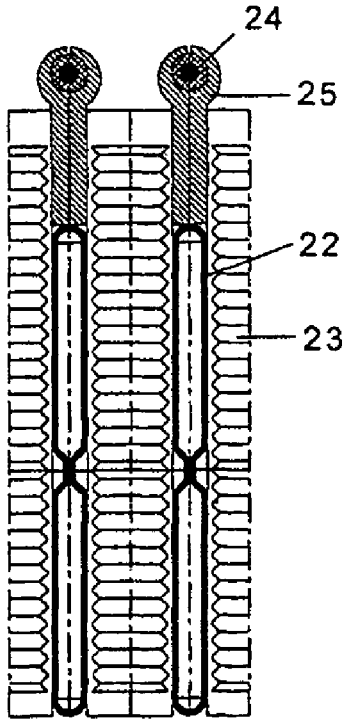
FIG. 3 shows a third exemplary embodiment.
Figure 4:
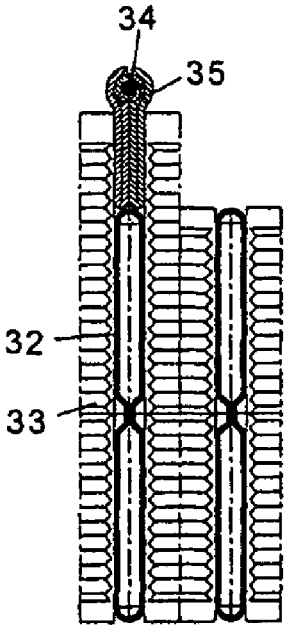
FIG. 4 shows a fourth exemplary embodiment.

In the other two exemplary embodiments illustrated in FIGS. 3 and 4, there are provided for the heating elements 24 and 34, special holding elements 25 and 35 which are themselves pressed into projecting rib sets 23 and 33 and, if appropriate, additionally secured. In these instances, too, the flat tubes 22 and 32 are conventional beaded tubes.

Alternatively, in a similar way to the first exemplary embodiment, the holding elements 25 and 35 may be soldered in at the same time as the manufacture of the heat exchanger without heating elements 24 and 34 and be provided with the heating elements 24 and 34 thereafter.

Figure 5:
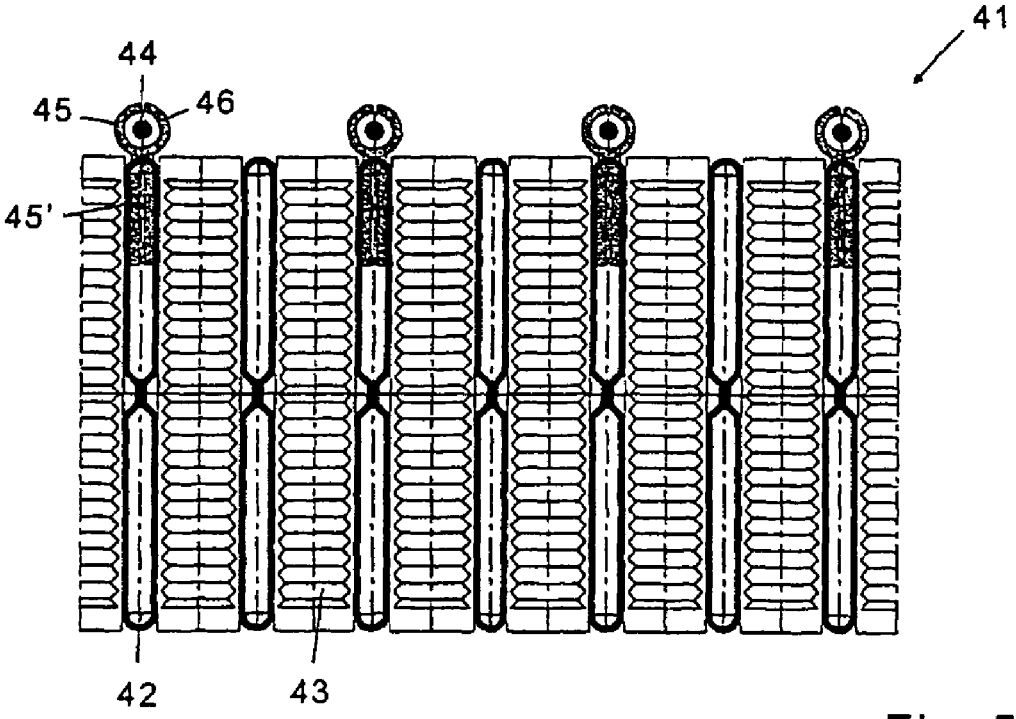
FIG. 5 shows a fifth exemplary embodiment.

According to the fifth exemplary embodiment illustrated in FIG. 5, for better thermal coupling of rib surfaces to the heating elements 44, a folding strip 45' consisting of a solder-plated aluminum strip is provided, which is pushed into the flat tubes 42, which are again beaded tubes, before and after the bundling and before the soldering, is fixed and is also soldered. Furthermore, the holding element 45 in the form of a holding grid 46 is tacked on to the bundled heat exchanger 41 in a similar way to FIG. 1, without the heating element 44 and insulation, by means of a wire connection or welding, and is also soldered.

According to the first exemplary embodiment, the heating elements 44 are inserted and crimped in after soldering. In the present exemplary embodiment, only every second row of flat tubes 42 is equipped with heating elements 44, but any other desired variants are also possible.

Figure 6:
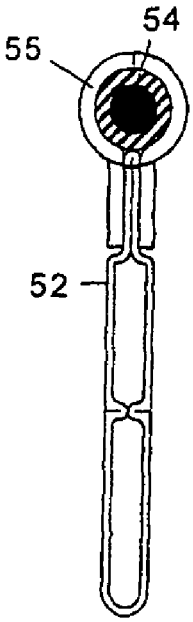
FIG. 6 shows a sixth exemplary embodiment.
Figure 7:
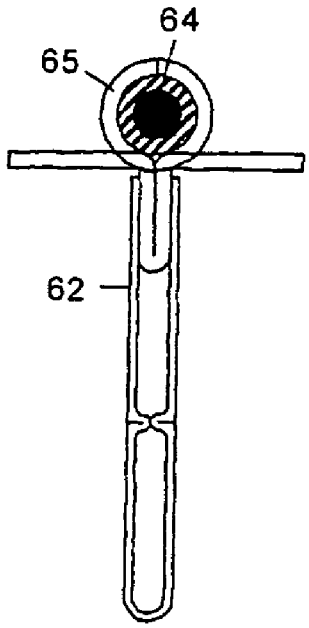
FIG. 7 shows a seventh exemplary embodiment.
Figure 8:
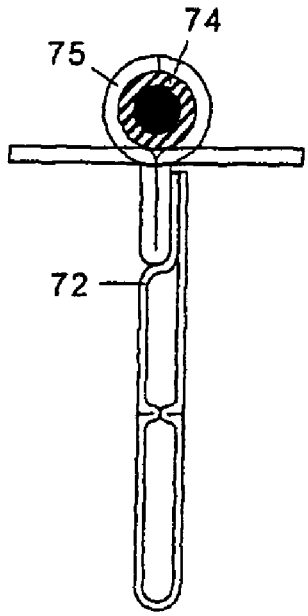
FIG. 8 shows an eighth exemplary embodiment.

FIGS. 6 to 8 show exemplary embodiments with modified flat tubes 52, 62 and 72, to which a heating element 54, 64 and 74 is fastened by means of a holding element 55, 65 and 75. According to the sixth exemplary embodiment (cf. FIG. 6), the holding element 55 comprises a flat-designed end of the flat tube 52, while, according to the seventh exemplary embodiment (cf. FIG. 7), the end of the flat tube 62 is of open design and receives the holding element 65. According to the eighth exemplary embodiment (FIG. 8), the holding element 75 is mounted laterally on the flattened flat tube 72, that side of the holding element 75 which is located opposite the common side being in alignment with the corresponding side of the flat tube 72.

Figure 9:
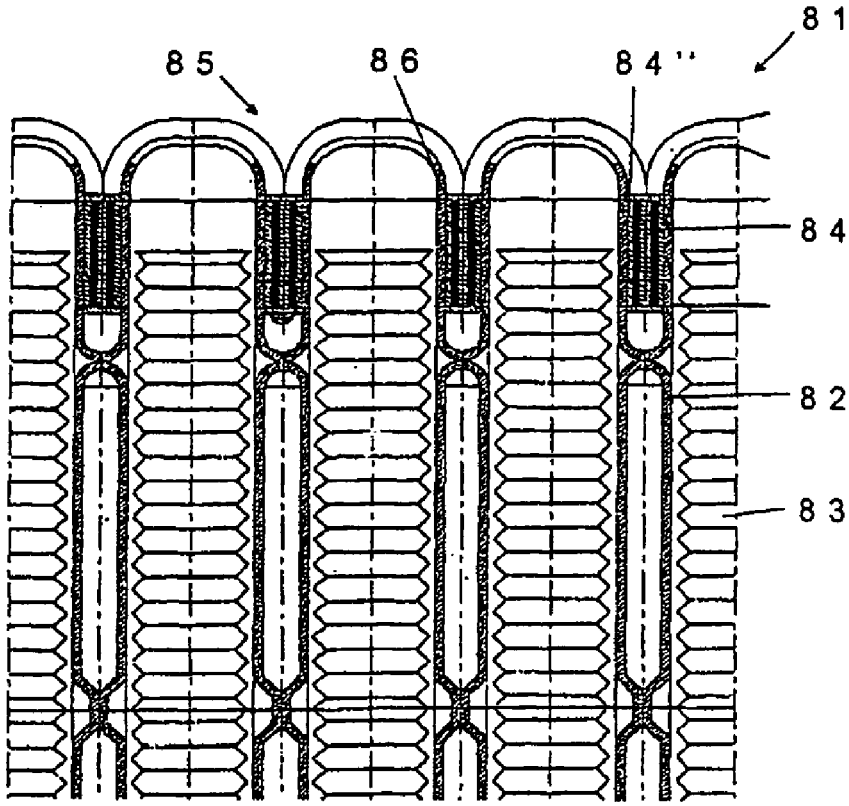
FIG. 9 shows a ninth exemplary embodiment.
Figure 10:
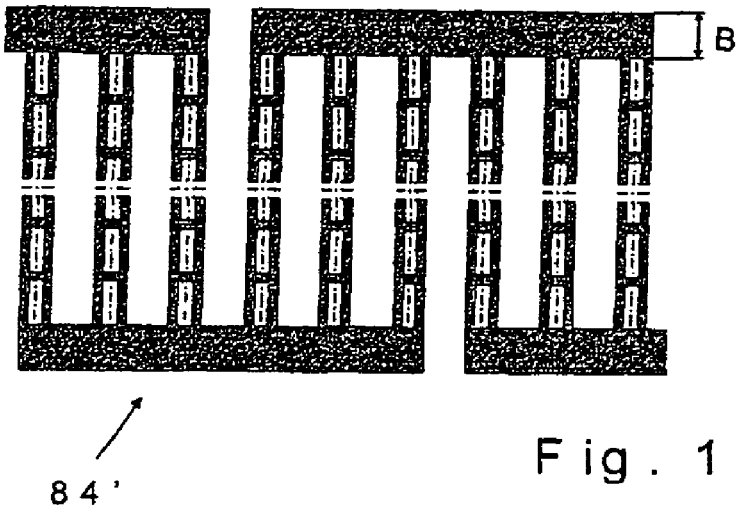
FIG. 10 shows a heating grid according to the ninth exemplary embodiment in a stretched-out illustration.

According to the ninth exemplary embodiment illustrated in FIG. 9, the holding element 85 provided is a holding grid 86 and the heating element 84 provided is a heating grid 84' which is illustrated, stretched out, in FIG. 10, FIG. 10 illustrating at the top the length which corresponds essentially to the length of the heat exchanger 81, that is to say to the tube length. For assembly, the holding grid 86 is bent in such a way that it can receive the correspondingly folded heating element 84. For this purpose, said holding grid is pushed between two rib sets 83, fixed in a known way, that is to say, for example, introduced before the soldering process and also soldered, and the heating element 84 is subsequently pushed or pressed into the open grooves.

This is essentially a heat exchanger of conventional type of construction, in which the gilled corrugated rib is replaced by a deeper rib, with the result that the rib projects beyond the flat tube 82 in order to receive the holding grid 86 and the heating grid 84' embedded in the latter. The holding grid may also be formed by individual U profiles which are not interconnected or by correspondingly pre-bent sheet metal strips.

The heating grid is produced, for example, by stamping and subsequent forming from one piece, a combination of parallel-connected and series-connected regions being possible in the present instance (cf. FIG. 10, in the present instance in each case three parallel-connected regions are connected in series), but a straightforward parallel connection or a straightforward series connection is also possible.

Figure 11:
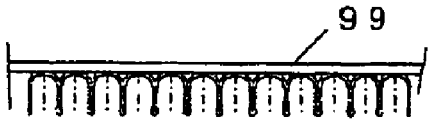
FIG. 11 shows a variant of the ninth exemplary embodiment.

To avoid short circuits between the heating grid 84' and the holding grid 86, the heating grid 84' is provided with an insulation layer 84". This insulation layer 84" is formed by an insulating lacquer. So that the width B of the current supply and current distributor strips of the heating grid of FIG. 10 can be made narrower, it is possible to reinforce these with an attached electrically conductive bar. A heating grid with a busbar 99 according to this variant is illustrated in FIG. 11. In this case, the busbar 99 also increases the mechanical dimensional stability of the heating grid and makes it easier to push it into the U-shaped receptacles of the holding grid.

According to a further tenth exemplary embodiment, a heating grid 104' serving as a heating element 104 is designed in such a way that it can be pushed in directly on the air outflow side between rib sets 103 projecting on the end face beyond the coolant-carrying flat tubes, without the risk of damage to the insulation layer and of a short circuit possibly resulting from this. According to the exemplary embodiment, the insulation layer is formed by a Teflon coating, but it may also be formed, for example, by correspondingly suitable lacquers, in particular stoving lacquers with sufficient temperature resistance, or the like.

Additional protection is afforded by a slight forming of the projecting ribs in the region of their corners, so that an introduction slope for the heating grid 104' is obtained. Forming may take place before the soldering of the heating body block or else thereafter, as illustrated in FIG. 12*a*. In this case, a special forming tool (indicated at the top in FIG. 12*a*) is introduced between the respective rib sets 103 in the introduction direction of the heating grid 104', so that the corners of the individual ribs are formed and thereby sloped.

Figure 12B:
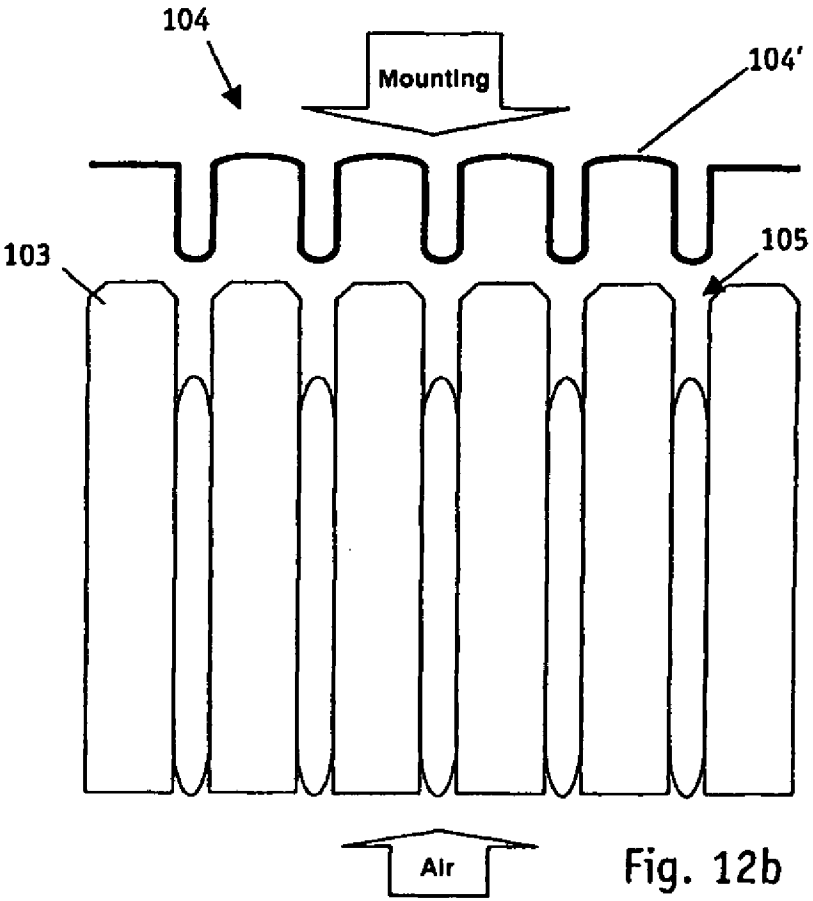
FIGS. 12*a* and 12*b* show a tenth exemplary embodiment, FIG. 12*a* showing the preparation of the rib sets serving as a holding element and FIG. 12*b* showing the assembly together with a heating grid.
Figure 12A:
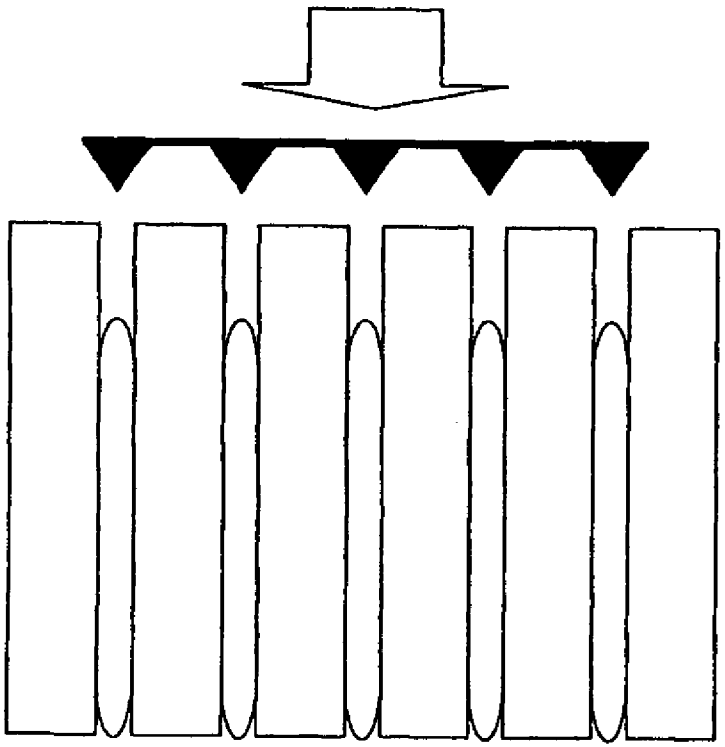

After the forming operation, as illustrated in FIG. 12*b*, the correspondingly bent heating grid 104' is introduced on the end face with respect to the flat tubes between the projecting rib sets 103 serving as a holding element 105. In the present instance, a heating section of the heating grid 104' is arranged between two adjacent rib sets in each case, but other variants are also possible, in which not every interspace between two rib sets receives a heating section of the heating grid. The individual heating sections of the heating grid 104' are connected by means of connecting webs and auxiliary connecting webs, as is evident from FIG. 13.

Figure 13:
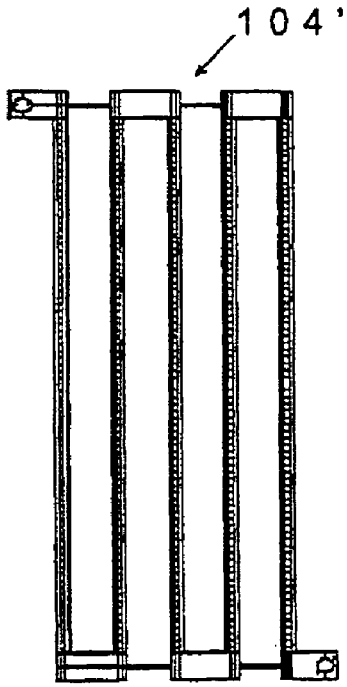
FIG. 13 shows a top view of the bent heating grid of FIG. 12*b;*

FIG. 13 shows the heating grid 104', there being provided between the individual heating sections, which run parallel to the flat tubes in the assembled state, connecting webs arranged on the end face and narrow auxiliary connecting webs which, in the assembled state, run beyond the end faces of the rib sets. The arrangement of the heating sections and connecting webs is meander-like, as also in the exemplary embodiment described above with reference to FIG. 10.

Figure 14:
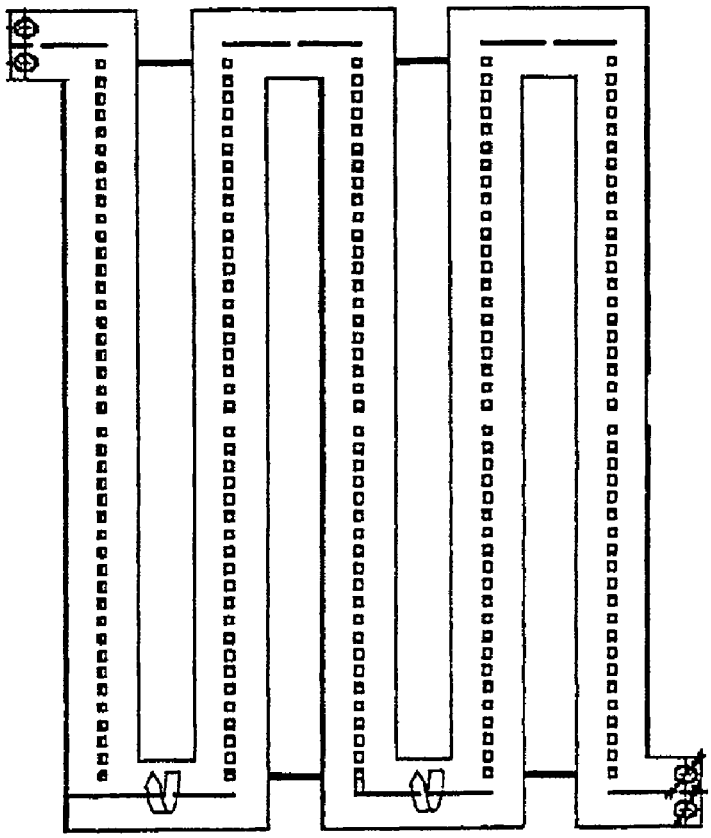
FIG. 14 shows a variant of a heating grid in a stretched-out illustration.

FIG. 14 shows a variant of the heating grid of FIG. 13, but in a stretched-out illustration, wider connecting webs being provided, which are folded round in order to double the material thickness, as indicated by arrows at the bottom of FIG. 14. It can also be seen from FIG. 14 that, in the middle of the heating sections, a predetermined bending line is provided by means of perforations, which at the same time prevents the axial current flow and consequently the generation of heat in the region of the contact point with the narrow sides of the flat tubes. The width of the remaining material between the individual perforations is dimensioned such that a sufficient elastic force can be applied so that the flanks of the heating sections are pressed against the rib sets. Alternatively, slots may also be provided, as illustrated in FIG. 10. If an additional holding grid is provided, pressing takes place against the latter. The heating grid according to the variant is stamped out from a heating conductor band material. By the doubling of material, tripling, etc. also being possible, the current density in this region can be lowered and therefore local heating at the connecting webs can be reduced, without an additional current conducting bar mounted at a later stage being necessary. The auxiliary connecting webs between the heating sections serve merely for improved handling during mounting and are severed after assembly has taken place. In the case of a holding grid without a current conducting function, the severance of the auxiliary connecting webs may be dispensed with.

By a folding in, if appropriate even multiple folding in of edge zones, for example also sheet edge zones, the material thickness and therefore the current-conducting cross section is enlarged. The same may, of course, also be achieved correspondingly by a use of what are known as tailored blanks as base material for the stamped sheets, and in these the edge zones assigned to connecting webs are of thicker design.

Figure 15:
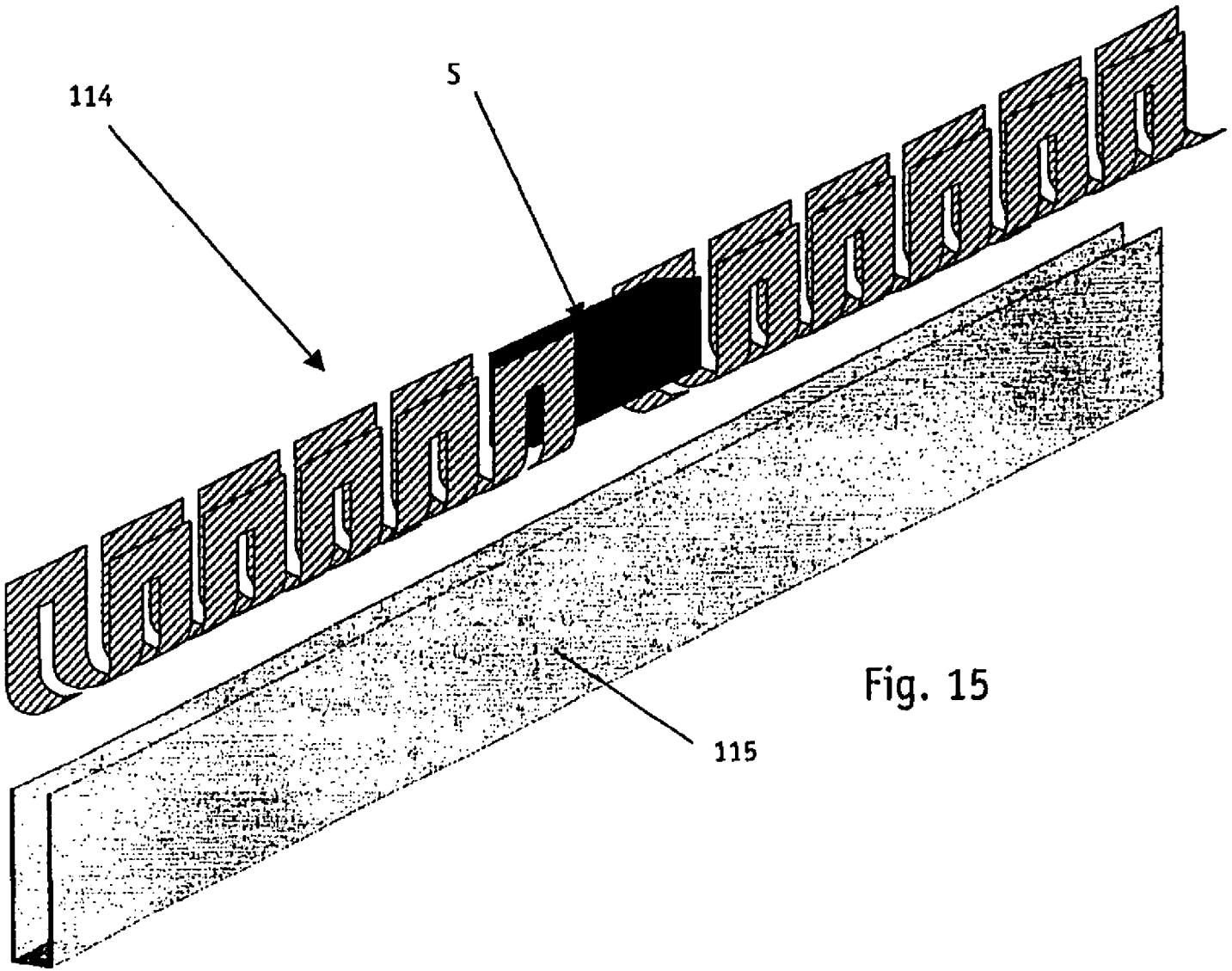
FIG. 15 shows an eleventh exemplary embodiment with an excess temperature cutout.

FIG. 15 illustrates an eleventh embodiment, according to which a polymeric PTC plastic element, designated below as a cutout S, is interposed centrally in the heating section (heating element 114 which is formed by a heating grid) which runs in a meander-like manner in a web of a holding grid (holding element 115) of U-shaped design. This cutout S serves for overheating protection and ensures that, at too high a temperature, no or only minimal current flows through the corresponding heating section and overheating is thereby prevented. For this purpose, the cutout element is designed in such a way that it likewise bears in a sheet-like manner against the flanks of the holding grid and consequently likewise discharges its lost heat to the latter. The holding grid and/or the heating grid are insulated relative to one another by means of a largely electrically non-conductive layer between them. The function of the holding grid is to absorb over a large area the heat discharged by the heating grid and to transfer the latter to the rib blocks adjacent thereto (see FIG. 17).

Figure 16A:
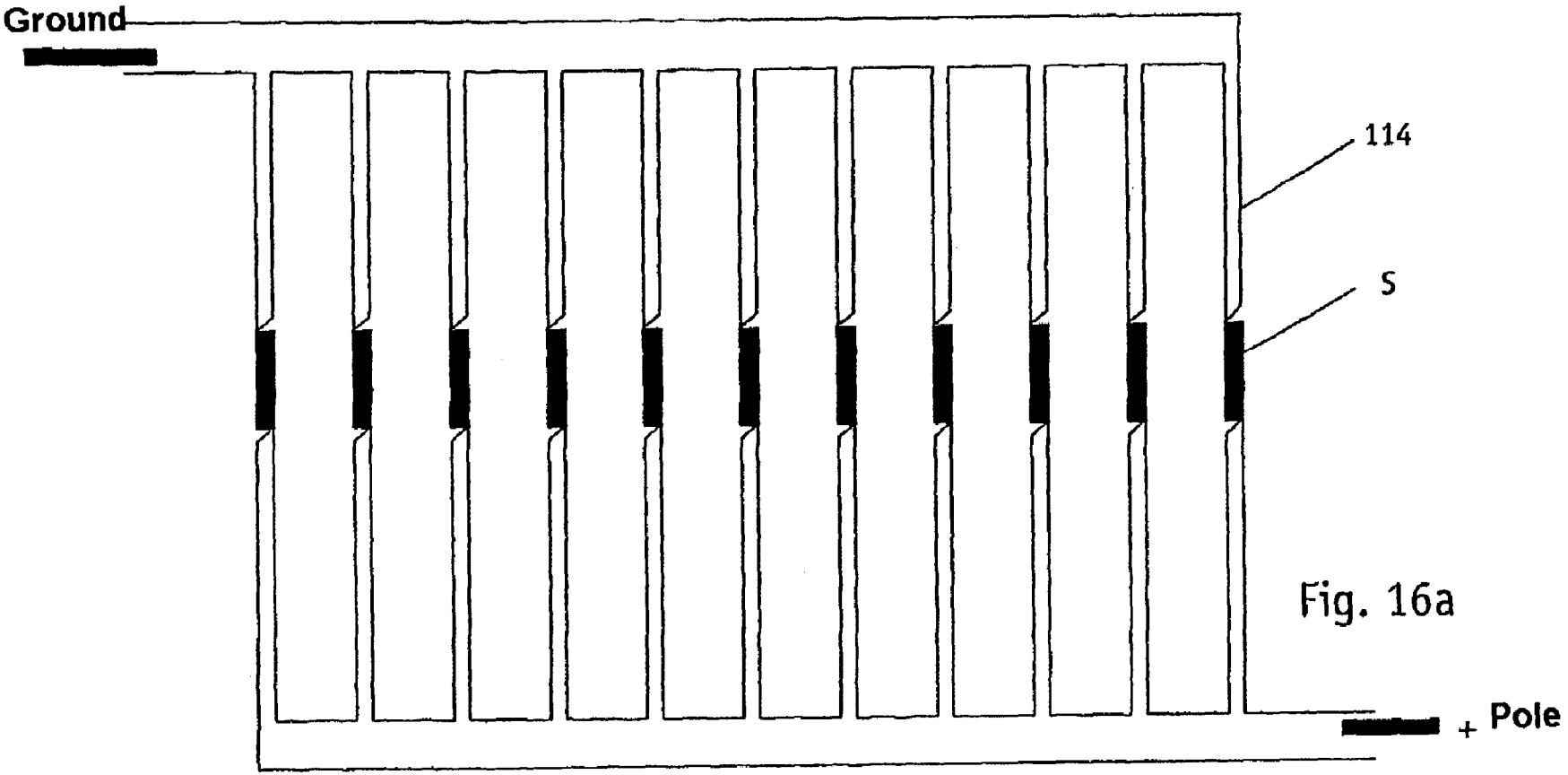
FIG. 16*a–c* show various circuits of heating grids with excess temperature cutouts.
Figure 16B:
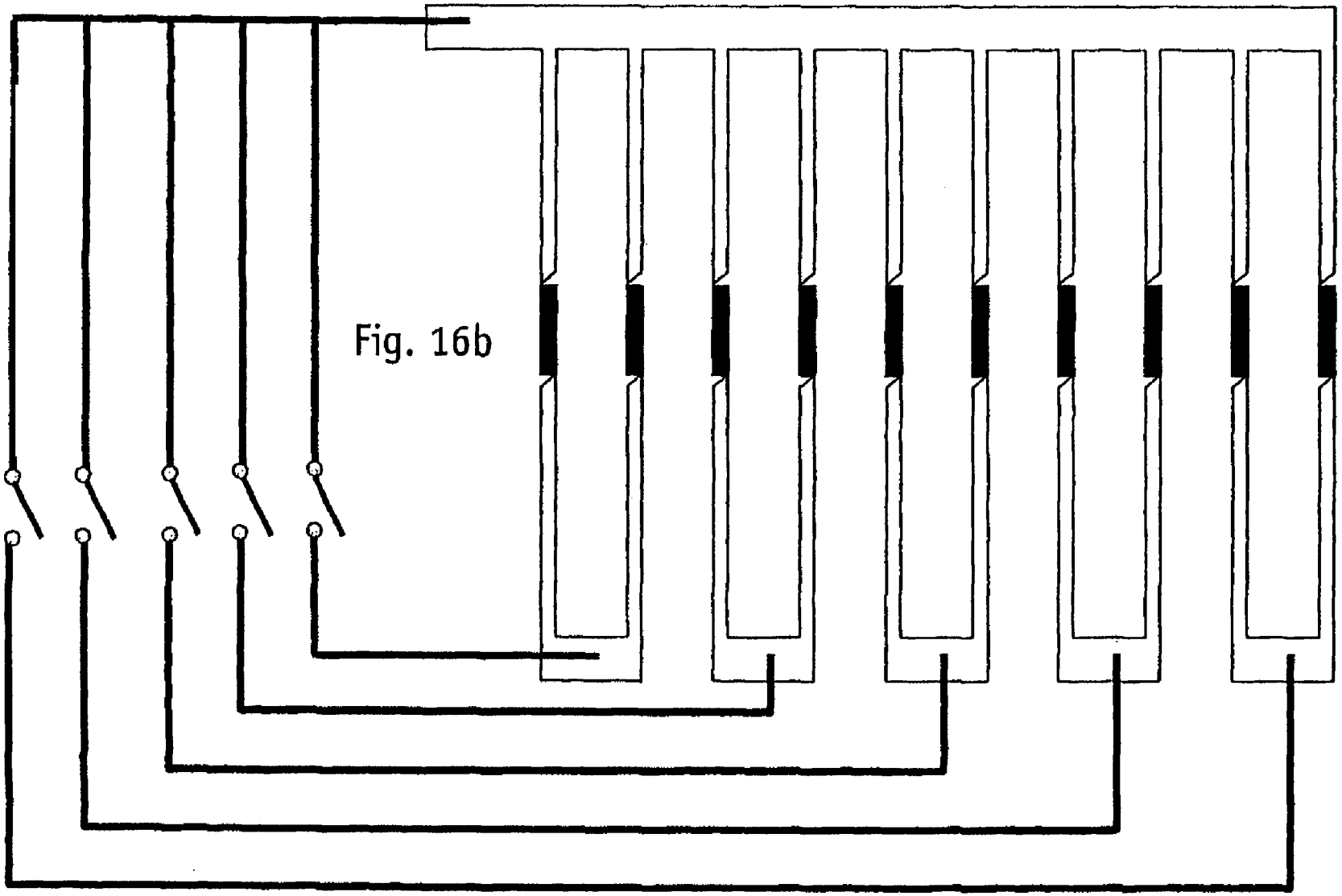
Figure 16C:
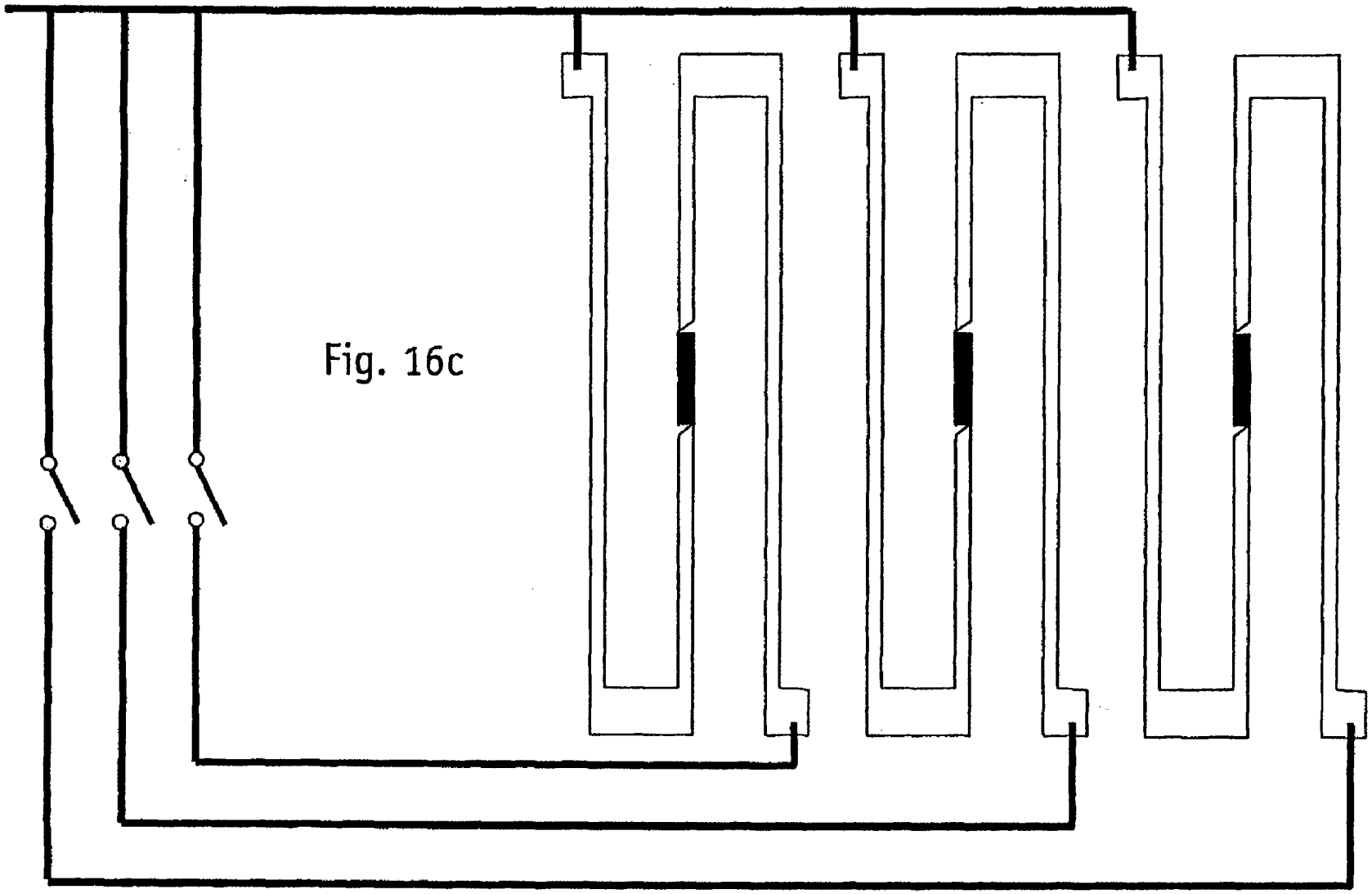

For this purpose, the entire structure of the heating elements is divided into a plurality of and consequently higher-impedance parallel heating circuits which are protected individually by means of more cost-effective overheating cutouts based, for example, on polymeric PTC elements. Thus, it is possible, inter alia, to prevent the electrical connecting bridges between individual heating sections from being overheated. Various circuits are illustrated in FIG. 16*a* to 16*c*. FIG. 16*a* shows a circuit in which all the webs of the heating grid are connected in parallel, each web being equipped with a series-connected overheating cutout. In this case, the individual webs must be of correspondingly high-impedance design, this preferably being achieved by means of the meander-shaped design, as illustrated in FIG. 15.

By use of other circuits, as illustrated, for example, in FIGS. 16*b* and 16*c*, the current flowing in the heating sections can be adapted to the current carrying capacity of the overheating cutout by an adaptation of the resistance.

Figure 17:
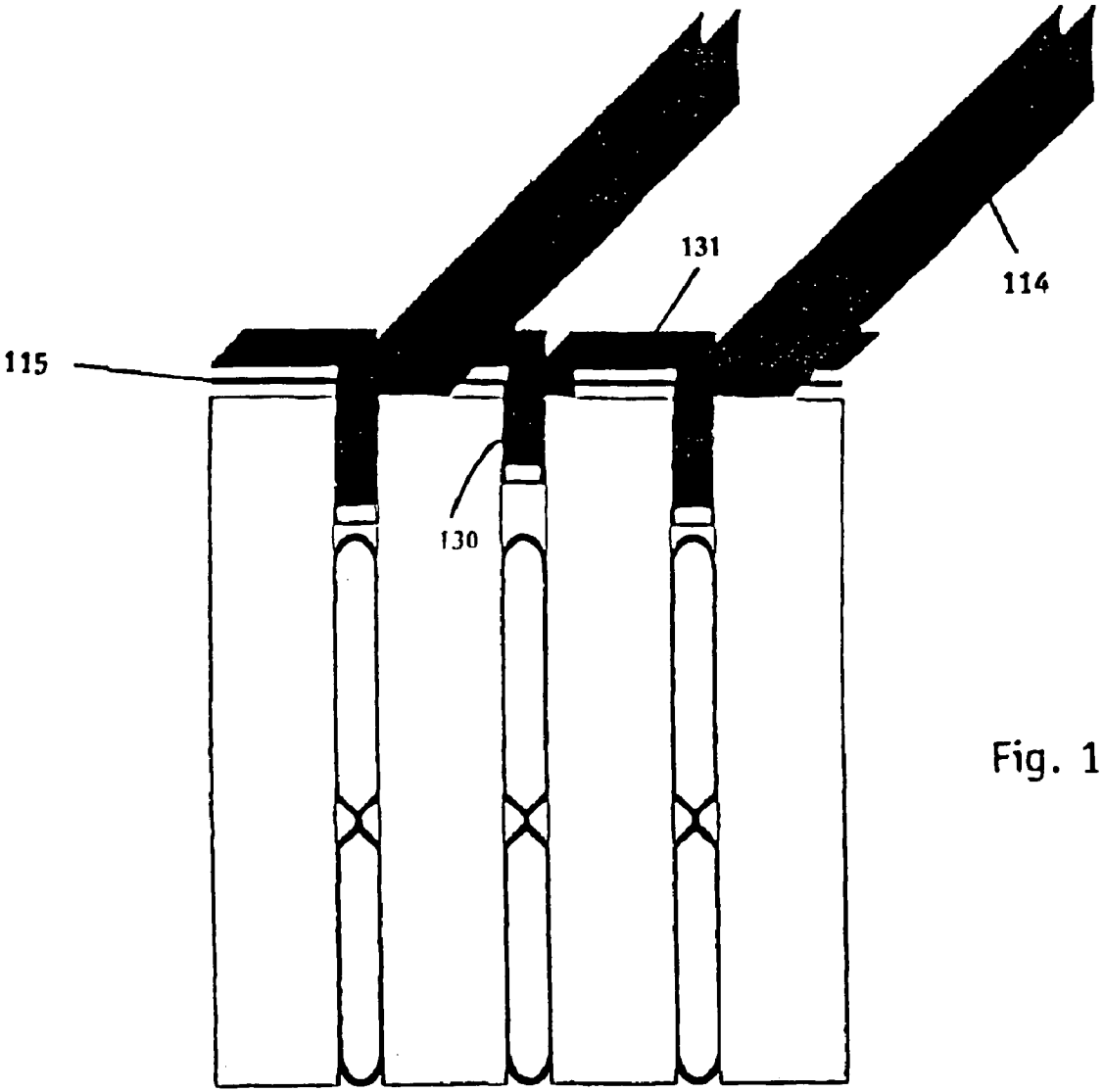
FIG. 17 shows a simplified overall illustration of the eleventh exemplary embodiment with intermediate cooling.

Intermediate cooling of the current bridges 131 by heat contact with the rib sets may take place in that, according to FIG. 17, the current bridges 131 are designed with an additional bead 130 as an intermediate cooling bead, said beads engaging into the free interspaces between the rib sets. In this case, however, heating sections of the heating grid are arranged only between every second rib set. It may be noted that the holding grid 115 is not illustrated in perspective in FIG. 17.

Alternatively to the illustration in FIG. 17, any other desired arrangements are possible, for example heating section, bead, bead, heating section. By the increase in the resistance by means of a meander structuring of the heating grid, the current flow through a section can be markedly reduced. This affords the possibility of keeping the loss heat occurring in the current bridges between the individual heating sections so low that the latter do not overheat, even without direct contact with the rib blocks.

Figure 18:
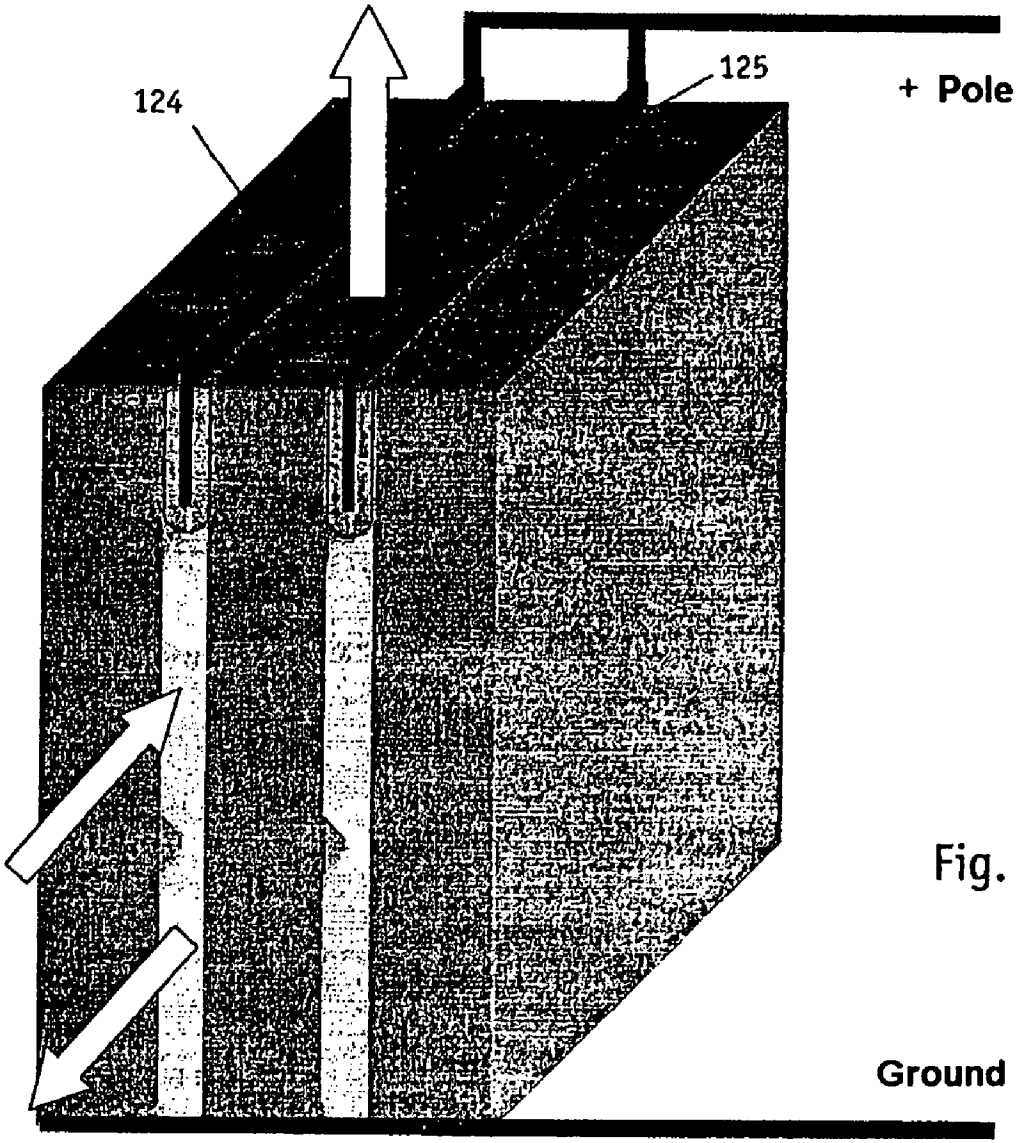
FIG. 18 shows a diagrammatic perspective view of a twelfth exemplary embodiment in order to illustrate the interconnection.

According to a twelfth exemplary embodiment illustrated in FIG. 18, a heating grid (heating element 124) lies as a composite structure directly in a holding grid (holding element 125). According to the present exemplary embodiment, this is possible due to the use of a composite structure consisting wholly of a plastic PTC structure and of an electrically conducting contact band. In this case, the current flow is routed from the inner electrode (+ pole) through the polymeric PTC structure outward to the holding grid which at the same time constitutes the other electrode (ground). The entire heat exchanger is in this case at a potential of the voltage source, preferably at ground potential.

To coordinate the resistance with the desired heating capacity, the specific resistance and also the area and thickness of the polymeric PTC material employed may be used and/or the resistance is adapted by means of circuitry measures. For this purpose, for example, the voltage may be supplied at first portions of middle electrodes.

Figure 19:
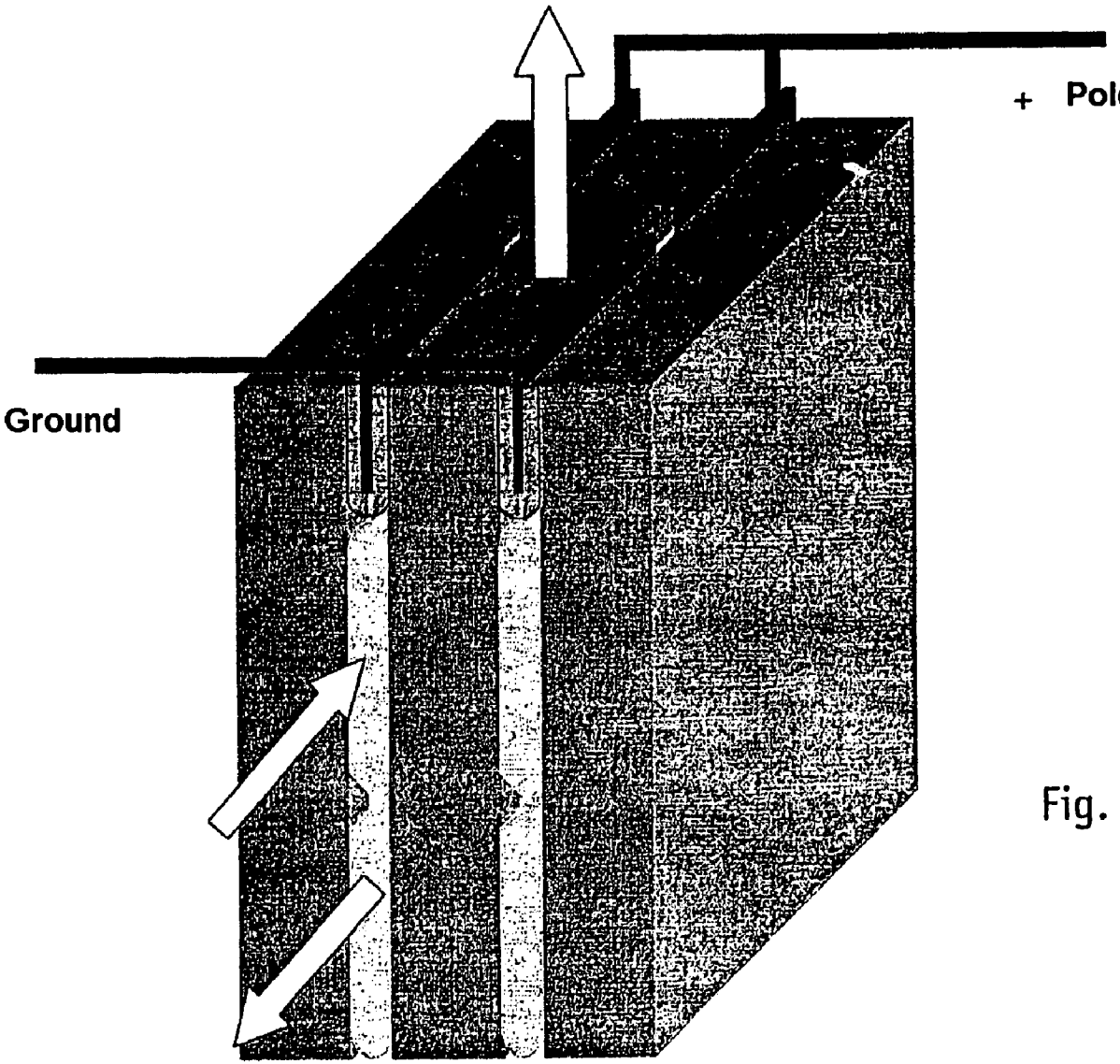
FIG. 19 shows a diagrammatic perspective view of a thirteenth exemplary embodiment in order to illustrate another interconnection.
Figure 20:
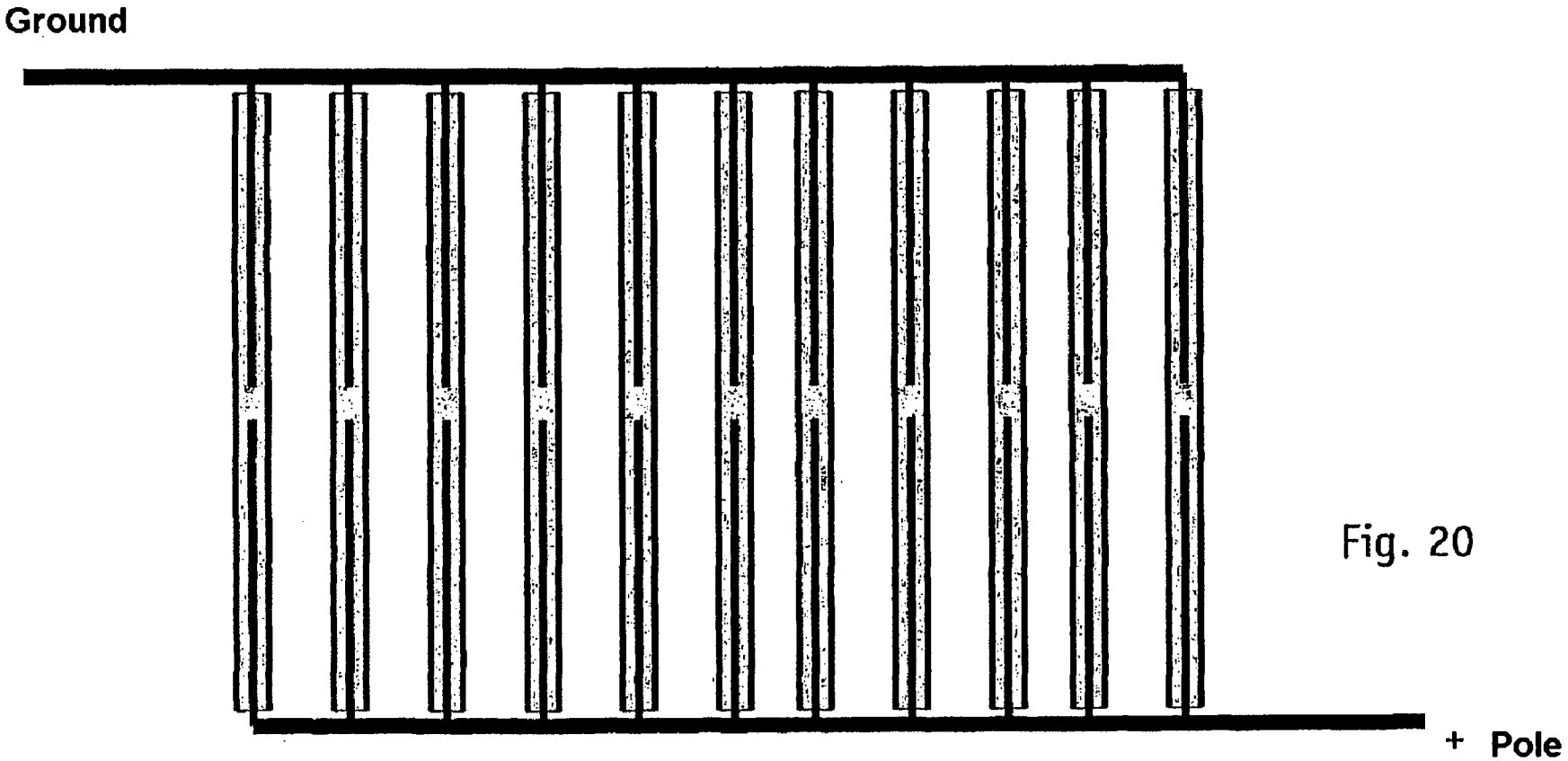
FIG. 20 shows the heating grid of FIG. 19 in a stretched-out illustration.
Figures 21A, 21B, 21C, 21D, 21E, 21F:
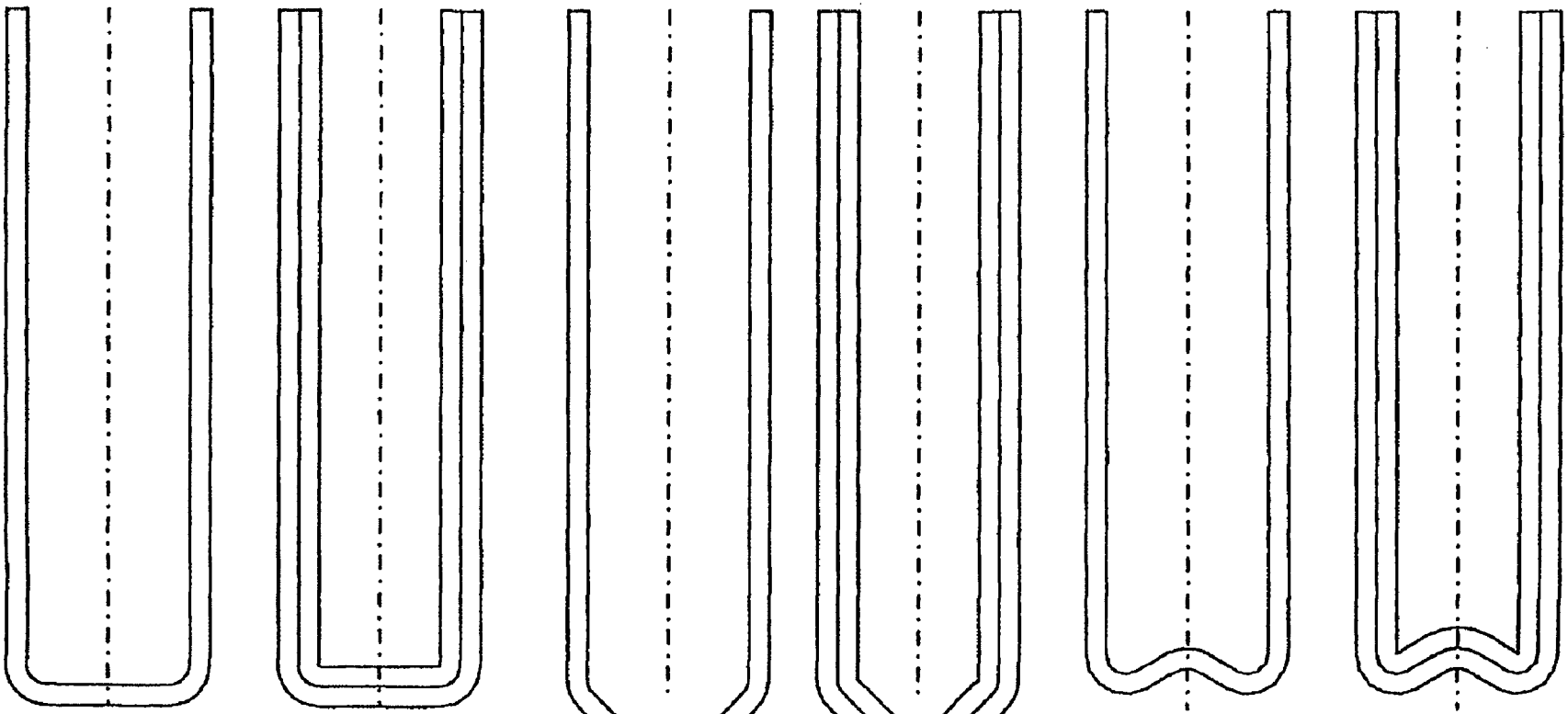
FIG. 21*a*–21*f* show various heating grid cross sections.

According to FIGS. 19 and 20 which illustrate a thirteenth exemplary embodiment, the current is in this case routed from the middle electrode to the holding grid and from there back to a second portion of the middle electrode. The holding grid is in this case at an intermediate potential and has to be insulated electrically from the heating body. Advantageously, the polymeric PTC material consists of a film which is laid in a U-shaped manner around the middle electrode and under light pressure stresses just fills the space within the holding grid, or it is designed as an extruded profile.

In this thirteenth exemplary embodiment with a middle electrode for contacting a polymeric PTC layer as a continuous heating element within a holding grid, a metallic heating conductor is dispensed with completely. As a result of the PTC characteristic, the heating structure itself is safe and requires no additional overheating protection.

The heating grid and/or holding grid may be bent according to the cross sections illustrated in FIG. 21*a* to 21*f*. The relatively angular U-profile illustrated in FIGS. 21*a* and 21*b* offers the largest contact surface and therefore the best heat transfer. The U-profile illustrated in FIGS. 21*c* and 21*d* and having a V-shaped design at the bottom offers tolerance compensation as a result of a resilient bearing contact of the flanks. The same also applies correspondingly to the U-profile illustrated in FIGS. 21*e* and 21*f* which is dented from below, in this case a longer bearing contact of the flanks and consequently better heat transfer being afforded. By virtue of the configuration according to FIG. 21*a* to 21*f*, a planar bearing contact of the heating grid flanks against the flanks of the holding grid is ensured, even in the case of a slightly variable thickness of the electric insulating layer.

The invention claimed is:

1. A heat exchanger for a heating or air conditioning unit in a motor vehicle, comprising:

a plurality of flat tubes which are arranged parallel to one another, wherein the cross-section of each flat tube includes long faces and narrow end faces;

a system for circulating a first heat transfer medium through each of the tubes;

at least a portion of the flat tubes having associated therewith an additional heating element comprising an electrically operated heating element which is mounted after soldering of the heat exchanger;

a holding element for fixing the heating element to the heat exchanger, wherein each heating element is mounted on the end face of its corresponding flat tube, wherein the holding element runs parallel to the flat tubes.

2. The heat exchanger as claimed in claim 1, wherein the holding element is formed by projecting rib sets, or the holding element is received between projecting rib sets.

3. The heat exchanger as claimed in claim 2, wherein the heating element or substantial regions of the heating element are pushed in at least partially between the projecting rib sets.

4. The heat exchanger as claimed in claim 2, wherein corners of the projecting rib set are rounded or sloped in a region of an introduction orifice of the heating element.

5. The heat exchanger as claimed in claim 1, wherein the holding element is a holding grid and/or in that the heating element is designed as a heating grid.

6. The heat exchanger as claimed in claim 1, wherein the holding element is mounted on the heat exchanger in a thermally conductive manner.

7. The heat exchanger as claimed in claim 1, wherein the heating element and/or the holding element has an insulating coating or is provided with an insulating coating.

8. The heat exchanger as claimed in claim 1, wherein the heating element is of meander-type design, individual heating sections which run parallel to one another being in each case connected on one side in each case to an adjacent heating section via connecting webs.

9. The heat exchanger as claimed in claim 8, wherein cooling beads are provided at current bridges between the individual heating sections.

10. The heat exchanger as claimed in claim 1, wherein the heating element and the holding element are produced in one piece as composite material.

11. The heat exchanger as claimed in claim 1, wherein one or more excess temperature cutouts are provided.

* * * * *